United States Patent [19]

Brodalla et al.

[11] Patent Number: 4,756,771

[45] Date of Patent: Jul. 12, 1988

[54] COLORLESS SEALING LAYERS FOR ANODIZED ALUMINUM SURFACES

[75] Inventors: Dieter Brodalla; Winfried Kirchhoff, both of Duesseldorf; Hans J. Goehausen, Langenfeld, all of Fed. Rep. of Germany

[73] Assignee: Henkel Kommanditgesellschaft auf Aktien, Duesseldorf, Fed. Rep. of Germany

[21] Appl. No.: 38,480

[22] Filed: Apr. 14, 1987

Related U.S. Application Data

[63] Continuation of Ser. No. 811,964, Dec. 20, 1985, abandoned.

[30] Foreign Application Priority Data

Jan. 3, 1985 [DE] Fed. Rep. of Germany ..... 3500079

[51] Int. Cl.[4] ..... C23C 22/84; C25D 11/24

[52] U.S. Cl. ..... 148/6.1; 148/6.27

[58] Field of Search ..... 148/6.1, 6.27; 8/422

[56] References Cited

U.S. PATENT DOCUMENTS

| | | | |
|---|---|---|---|
| 2,927,872 | 3/1960 | Cohn | 148/6.1 |
| 3,012,917 | 12/1961 | Riou et al. | 148/6.14 |
| 3,767,474 | 10/1973 | Cohn | 148/6.1 |
| 3,874,902 | 4/1975 | Andrus | 117/71 |

FOREIGN PATENT DOCUMENTS

| | | |
|---|---|---|
| 3301507 | 7/1983 | Fed. Rep. of Germany . |
| 5011764 | 6/1979 | Japan . |
| 2082975 | 3/1982 | United Kingdom . |
| 2137657 | 10/1984 | United Kingdom . |
| 2140033 | 11/1984 | United Kingdom . |

OTHER PUBLICATIONS

Chemical Abstracts 87, 75493t, 1977.

Aluminium 47, No. 4 245–253 (1971).

Ullmanns Encyklopaedie der technischen Chemie, 1961, Urban & Schwarzenberg, Muechen–Berlin, p. 194 (translation enclosed).

*Primary Examiner*—Sam Silverberg

*Attorney, Agent, or Firm*—Ernest G. Szoke; Henry E. Millson, Jr.; Mark A. Greenfield

[57] ABSTRACT

A process and composition for producing colorless, cold-sealed, anodized aluminum or aluminum alloy surfaces. The composition comprises an aqueous solution containing nickel ions and a solution of at least one azo or azo metal dye, the colors imparted by the nickel ions and dye offsetting each other.

35 Claims, No Drawings

COLORLESS SEALING LAYERS FOR ANODIZED ALUMINUM SURFACES

This application is a continuation of application Ser. No. 811,964, filed Dec. 20, 1985, now abandoned.

BACKGROUND OF THE INVENTION

1. Field of the Invention

The invention relates to compositions and to a process for generating colorless sealed layers on anodized aluminum surfaces in the course of "cold sealing".

2. Statement of the Related Art

In contrast to "hot sealing", in which the pores of anodized aluminum surfaces are closed and rendered corrosion resistant by treatment with water, steam, or metal salt solutions at a temperature above 90° C., in the art the terms "cold sealing" or "cold impregnation" or "low temperature sealing" are generally understood to denote processes by which the porosity of anodized aluminum surfaces is reduced at a temperature of 15° C. to 70° C., and the surface properties thereof are substantially improved. These processes are intended to provide improved corrosion resistance over that of unsealed surfaces.

The underlying mechanisms of the actual sealing process have so far not been elucidated in all details. Nevertheless, it can be said that in the region adjacent to the surface of the aluminum oxide layer which is formed on aluminum metal upon contact with oxygen the pores are closed by the incorporation of aluminum oxide hydrates, e.g. boehmite. However, in the course of sealing it is undesirable that such a mineral coating is formed on the surface of the oxide layer as well, as this coating is not resistant to handling and the surfaces of the anodized aluminum parts will become spotty and defective in appearance. Thus, methods for sealing metallic surfaces by forming additional inorganic protective layers such as described in U.S. Pat. No. 3,012,917 have not been accepted in technical applications.

Processes to effect cold sealing of anodized work pieces made of aluminum and alloys thereof are known in the prior art. Thus, Chemical Abstracts, 87, 75493t (1977) describes employing solutions of various metal fluorides, for example $CrF_3$, $MnF_2$, $CoF_2$ or $NiF_2$, for treating anodized aluminum surfaces at from room temperature to 50° C. Published Japanese patent application No. 50-117,648 describes the sealing of anodized aluminum surfaces by immersion into an acid solution containing a metal (such as nickel) fluoride and isoamyl alcohol at 30° C.

Published British patent application No. 2,137,657 (and corresponding German patent application No. 33 01 507) also describe a process for cold sealing of aluminum or aluminum alloy surfaces in which process solutions containing fluorine or fluoride or complex fluoride anions (such as nickel fluoride and/or cobalt fluoride) are employed at temperatures of 25° to 60° C. Similarly, published U.K. patent application No. 2,140,033 (and corresponding published German patent application No. 34 11 678) disclose a process for after-sealing of aluminum and aluminum alloys subsequent to electrolytic anodization wherein nonionic surfactants capable of reducing the surface tension of the sealant bath are added to aqueous solutions containing at least one nickel salt. Useful nonionic surfactants include fluorocarboxylates and organosiloxanes.

All of the described processes have in common that aqueous solutions of certain nickel salts are used. The nickel ions are incorporated in the surface layer upon contact with the freshly anodized aluminum surfaces. In consequence thereof, depending on the types of ions also included, a more or less intense greenish coloration of the aluminum surfaces occurs, which is particularly cleanly visible from either an oblique top view or at an acute view angle. In work pieces for decorative use, the greenish surface discoloration is very annoying, since thereby the actual natural shade of the aluminum metal is changed.

Processes for removing or eliminating undesired colorations or discolorations of anodized surfaces of certain aluminum alloys have been described in U.S. Pat. No. 3,874,902 (and corresponding published German patent application No. 25 10 246). In the process disclosed, alterations of the color of aluminum surfaces resulting from alien metals of the aluminum alloys, e.g. copper, are eliminated by adding a monoazo dye to the bath at a temperature which must be maintained at about 180°-210° F. (82°-98° C.) and at a pH which must be between about 5.5 and 6.5, for a time of 10-30 minutes. However, the disclosure teaches removing only those discolorations which have been formed from nonaluminum components of the aluminum alloy in the anodization step preceding the sealing. As treatment accelerators there can be added metal salts, such as cobalt or nickel salts. However, the addition of accelerators renders the color control difficult.

In the aluminum industry, monoazo dyes are mainly used to provide anodized aluminum surfaces with a desired color. The dyes penetrate into and are adsorbed in the porous surface layers of anodized aluminum parts, after which the colored layers primarily are sealed by treatment with hot aqueous solutions. The sealing solutions are at the same time provided with further additives which will hinder the formation of sealing coatings [see "Aluminium" 47, 245 (1971)]. In those cases, the addition of low amounts of nickel salts, such as nickel acetate, or pre-treatment of the surfaces with nickel salt-containing solutions are often required to prevent the dyes from exudation from the pores and to avoid an undesirable alteration in the color shades as imparted by the organic dyes.

However, in cold sealing using solutions containing nickel salts, an undesired greenish discoloration of the surface occurs due to the components of the solutions required for the sealing process.

DESCRIPTION OF THE INVENTION

The present invention provides a process for the cold sealing of anodized aluminum surfaces in which (in spite of the use of aqueous solutions containing nickel salts) colorless layers can be produced and the greenish coloration imparted by nickel ions to the surface layers can be avoided. Aqueous solutions of nickel fluoride absorb light in the wave length ranges of from 350 to 450 nm and from 650 to 850 nm. Now it has suprisingly been found that selected dyes having absorption maxima in the range of from 450 to 600 nm, and preferably from 490 to 560 nm, when used conjointly with aqueous solutions of nickel salts, allow the cold sealing of anodized aluminum surfaces to be accomplished without a visible occurrence of greenish colorations of the surfaces. In the cold sealing of aluminum surfaces using nickel salt solutions containing such dyes, the surfaces formed show the natural shade of aluminum.

Other than in the operating examples, or where otherwise indicated, all numbers expressing quantities of ingredients, reaction conditions, or defining ingredient parameters used herein are to be understood as modified in all instances by the term "about". Moreover, the term "g/l" as used herein, refers to grams per liter of the respective sealing or replenisher solution, the term "mg/l" referring to milligrams per liter of the respective sealing or replenisher solution. When these terms are used with nickel salts, they refer to a measurement based upon the nickel ions.

The present invention provides compositions for producing colorless sealed layers on anodized aluminum surfaces at a temperature of 15° to 70° C. and at a pH of 5 to 7.5. The compositions contain from 1 to 5 grams of nickel cations per liter of sealing solution in the form of a water-soluble nickel salt; at least one organic dye having (a) an absorption maximum in the range of 450 to 600 mm, (b) a Beer's law extinction coefficient of at least $10^3$ liter/mol cm, and which are (c) capable of being dissolved to form a molecular dispersion, while (d) not undergoing a precipitation reaction with the nickel ions and/or the other components of the solution at the application concentrations; and, optionally, further organic and/or inorganic auxiliary agents conventional in the cold sealing of anodized aluminum surfaces.

The present invention also provides a process for producing colorless sealed layers by treating anodized aluminum surfaces with aqueous solutions containing nickel ions and, optionally, further organic and/or inorganic auxiliary agents conventional in the cold sealing of anodized aluminum surfaces. The treatment is conducted at a temperature of 15° C. to 70° C. and pH of 5 to 7.5. The inventive process is particularly characterized by the addition (optionally continuously) of at least one organic dye as described immediately above, to the aqueous sealing solution.

More specifically, the dyes suitable for use in the composition and process according to the present invention can only be those dyes which meet all of the following critera (a) through (d).

(a) The dyes must have a maximum of light absorption in the visible region at wave lengths in the range between 450 and 600 nm. A preferred absorption range of the dyes is from 490 to 560 nm. An addition of an aqueous dye solution showing a red color in the absence of other colorant substances, to an aqueous green-colored solution of soluble nickel salts in a suitable concentration, results in an optical decoloration of the two solutions. That is, the mixture appears to be colorless.

(b) The dyes must have an extinction coefficient of at least $10^3$ liter/mol cm. At a given nickel content of the sealing solution the concentration of the dyes is from 0.5 to 80 mg/l, which, however, will depend on the specific extinction of the respective dye. A high color intensity—corresponding to a high extinction coefficient—preferably in the range from $5\times10^3$ to $5\times10^5$ liter/mol cm allows the use of low dye concentrations. As preferred according to the invention concentrations of 1.0 to 10.0 mg per liter of the sealing solution are used, 1 to 2.9 mg/l being particularly preferred. Since dyes having lower color intensity will have to be employed in accordingly higher concentrations and high concentrations applied can adversely affect the quality of the sealing process, dyes having low extinction coefficients are not suitable for the invention.

(c) The dye molecules as well as the nickel ions must penetrate into the pores of the anodized aluminum surfaces in order to ensure a permanent decoloration of the surfaces to be effected by the inventive process. At a given pore diameter of the aluminum oxide hydrate layer the size of the dye molecules must not exceed a definite value. To meet this requirement the dye molecules must be dissolved so as to form a molecular dispersion. In other words, they must be present in the form of a true solution. Thus, it is critical that at given concentrations of nickel ions and of dye molecules, the ions and molecules are incorporated in the aluminum oxide hydrate layer in a ratio such that absorption of the light energy of the complete visible spectrum is accomplished.

(d) Generally the nickel concentration in the sealing solution is 1 to 5 g per liter of the solution, preferably 1.4 to 2.8 g/l, most preferably about 2 g/l. The dye added in accordance with this invention must not undergo any precipitation reaction, such as a transcomplexing reaction, with the nickel salts when they are used in the foregoing, or in any other, concentrations. The dye necessarily must also be compatible with the other components of the solutions, or subsequent reactions could deplete the dye in the sealing solution below the amount required for the invention.

Among a multitude of available dyes, selected azo dyes and azo metal dyes have suprisingly proven to be suitable to meet all of the above criteria (a) through (d). A large group of azo dyes and azo metal dyes are not suitable, either due to their molecular size (i.e. they connot diffuse into the pores of the aluminum oxide hydrate surface) or because they form precipitates with the nickel ions of the sealing solutions.

The use of the azo dyes meeting the severly limiting criteria of the present invention results in the nickel ions and the dye molecules being incorporated in the aluminum oxide hydrate layer in such a ratio that the light energy of the total visible spectrum is absorbed. Typically, at a pre-determined nickel concentration of from 1 to 5 g/l, and at a dye concentration of from 1 to 10 mg/l, the treatment according to the invention is carried out for a period of from 0.1 to 1.5 minutes per micron ($\mu$) of layer thickness.

Examples of useful dyes within the scope of the present invention are those sold under the trade designations Aluminiumrot GLW (aluminum red GLW) and Aluminiumviolett CLW (aluminum violet CLW) by the Sandoz Company. Aluminum red GLW is an azo metal complex containing copper, and aluminum violet CLW is a purely organic azo dye. These dyes have a high color intensity (the extinction coefficients are about $10^4$ liter/mol cm) an absorption maximum at 500 nm and 555 nm, respectively, and, due to their small molecular size (molecular weights ranging from 800 to 1,000), readily diffuse into the pores of the anodized aluminum surfaces. When these dyes are employed, a dye concentration of about 2.5 mg/l has proven to be appropriate for use together with a nickel concentration of about 2 g/l, the treatment solution containing all components being of colorless appearance.

In contrast to several other dyes from the class comprising azo dyes and azo metal dyes (such as aluminum red RLW, aluminum copper, aluminum bordeaux RL, aluminum fire-red ML) the aluminum red GLW and aluminum violet CLW dyes useful in this invention do not form precipitates of metal complexes but remain dissolved as a molecular dispersion in the aqueous sealing solutions, even for an extended period of time.

The sealing process of this invention uses aqueous solutions prepared by dissolution of nickel salts such as nickel fluoride tetrahydrate or nickel salts such as nickel sulfate or nickel acetate and the addition of corresponding amounts of alkali metal fluorides. The sealing solutions according to the invention may optionally contain one or more further organic and/or inorganic auxiliary materials which are conventional in the technique of cold sealing of anodized aluminum surfaces. These may be, for example: tensides (surfactants); organic compounds such as alcohols, amines, ketones and/or ethers; organosilicon compounds; fluorides of various metals; or salts comprising complex anions. However, such materials are not essential, and sealed anodized aluminum surfaces having a colorless appearance are also obtained when such conventional auxiliarly materials are absent.

It is within the scope of this invention to treat a surface of anodized aluminum or an alloy thereof with an aqueous solution of a dye according to the invention in a preliminary step, and then in a subsequent step to seal the surface in accordance with the cold sealing procedure using an aqueous nickel solution. The reddish color of the aluminum oxide surface as produced in the first step will be offset by the subsequent greenish coloration resulting form the sealing step, so that the treated surfaces of anodized aluminum will appear to have the color of natural aluminum. However, such a dye rinsing bath will always have to be operated using a water overflow, which makes it more difficult to maintain a predetermined dye concentration and results in high losses of dye. Moreover, in conventional industrial anodizing lines used for the fully automatized treatment of aluminum surfaces, there is no room left for the insertion of a separate preliminary dyeing bath. Thus, this embodiment, while chemically feasible, is not preferred.

It also is within the scope of this invention (at least theoretically) to seal the anodized aluminum surface with an aqueous solution containing a nickel salt as a preliminary step and then, to a subsequent step, to treat the surface with a solution containing the dye, thereby offsetting the greenish surface coloration caused by the incorporated dye molecules in the pores of the anodized aluminum surface. Apart from the fact that conventional industrial anodization lines do not have any room for adding an additional separate dyeing bath, this procedure has the drawback that the dye molecules will distinctly less readily penetrate into the pores that have already been partially closed by the sealing process. As a result, a full offset compensation of the greenish discoloration caused by the incorporated nickel ions is no longer ensured. In particular, a permanent offset of the greenish color is rendered difficult by the fact that the dyes are only superficially applied and are thus readily removable or susceptible to being bleached or leached by other environmental influences. Thus, this embodiment, while chemically feasible under some conditions, is the least preferred of the three disclosed.

It is for these reasons that, in accordance with the present invention, an integrated process is preferred wherein dyeing and sealing are simultaneously effected. To achieve this, aqueous solutions are prepared which contain the previously disclosed concentrations of nickel in the form of at least one water-soluble nickel salt, and 0.5 to 80 mg/l of at least one organic dye which must meet the criteria (a) through (d) as previously set forth. Optionally, the solution may contain further organic and/or inorganic auxiliary materials conventionally used in the cold sealing of anodized aluminum surfaces. The solutions preferably contain 1 to 10 mg/l, most preferably 1 to 2.9 mg/l of the dye. In each instance, the respective dye concentrations will depend on the nickel concentration, on the one hand, and on the color intensity of the employed dye, on the other hand.

In a particularly preferred embodiment of the process according to the invention there are used treatment solutions wherein the green coloration caused by the presence of nickel ions is completely offset by the red coloration caused by the presence of the dye molecules and which, thus, appear to be colorless. Thus, dyes having an extinction coefficient in the range of $5\times10^3$ to $5\times10^5$ liter/mol cm at an absorption maximum in the range of from 490 to 560 nm and at a concentration of from 1 to 10 mg/l, will decolorize sealing solutions which contain from 1 to 5 g/l of nickel.

Anodized surfaces of aluminum or its alloys are treated with the inventive dye solutions: at a temperature of 15° C. to 70° C., preferably 20° C. to 40° C., more preferably 25° C. to 32° C.; and at a pH value of 5.0 to 7.5, preferably 5.5 to 7.0, ideally 6.5. The treatment is effected by immersing the aluminum articles to be treated in the inventive solutions for 0.1 to 1.5, preferably 0.4 to 1.2, minutes per micron ($\mu$) of layer thickness. It is desirable that the articles are subsequently rinsed with fully desalted water.

In the course of the treatment, nickel ions and dye molecules are incorporated in the pores of the aluminum oxide surface. In consequence thereof the treatment solution is depleted of these components, so that their concentrations have to be continuously monitored. This may be accomplished by complexometric titration of the nickel content of the solutions, and/or by monitoring the extinctions of the solution using spectrophotometry at the characteristic absorption wave lengths of nickel (395 nm and 720 nm) and of the employed dye (500 nm or 555 nm, respectively). A continuous decrease in the concentrations of the two colorant components indicates that the two components are being incorporated in the pores of the aluminum oxide surfaces and a mutual color offset is taking place. A constant value for the dye concentration in the solution will signal that the dye molecules are not incorporated. In consequence, in the first instance there results an uncolored aluminum surface showing the apparent color of natural aluminum, while in the second instance the surface shows a greenish color.

In a preferred embodiment of the process according to the invention the sealing solutions are replenished in accordance with the consumption of the components thereof, so that it is possible to run the process continuously. To this purpose the nickel content and the dye content are adjusted to respectively predetermined constant values by the addition of the respective bath components in solid or solution form, and the constancy of these as well as other significant bath parameters is continuously monitored.

When the inventive agents and process are employed, colorless sealed surfaces of anodized aluminum or its alloys are produced which do not show any discolorations. Due to their having the apparent color and shade of natural aluminum metal, the surfaces having thus been treated are excellently suitable for decorative purposes. In addition, the degree of corrosion resistance is certainly not deteriorated by the application of the process according to the invention. Thus, naturally colored aluminum surfaces for decorative use may be produced via the cold sealing route by means of the process according to the invention.

EXAMPLES

The present invention is further illustrated by way of the following non-limiting examples.

In the following examples, sheets of the alloy AlMg 3 [DIN (German Industrial Norm) material No. 3.3535] were degreased, rinsed, mordanted, after-rinsed and anodized by the GS method while the following process parameters were maintained:

| | |
|---|---|
| Current density | 1.5 A × $dm^{-2}$; |
| Temperature | 20° C. |
| Layer thickness | 20μ; and |
| Sulfuric acid content | 180 g/l |

Then the specimens were rinsed with fully desalted water.

In the actual process of sealing the aluminum oxide surfaces, there were used aqueous solutions having compositions as indicated in the individual examples. The pH was between 5.5 and 6.5 and was readjusted with acetic acid when necessary. The temperature of the treatment was 28° C. to 32° C., and the duration of the treatment was 0.5 minutes per micron (μ) of layer thickness.

The nickel content in the solutions was monitored by means of complexometric titration. In addition, the solutions were subjected to spectrophotometric analysis in cuvettes having a path length of 1 cm. The extinctions at the characteristic absorption wave lengths (Ni: 395 and 720 nm; dyes: 500 or 555 nm, respectively) directly depend on the respective concentrations so that they can be correlated therewith.

Example 1 (violet dye)

The total starting solution contained:

7.0 g/l of $NiF_2.4\ H_2O$; and 3.0 mg/l of aluminum violet CLW.

The pH value was 5.8.

The changes in the concentrations of the colorant bath components were traced by complexometric and photometric analyses. The results are listed in the following Table 1.

TABLE 1

| $m^2$ of anodized surface per liter of bath | Extinct. at 395 nm (Ni conc.) | Extinct. at 720 nm (Ni conc.) | Extinct. at 555 nm (dye conc.) | Ni content complexo-metric. g/l |
|---|---|---|---|---|
| 0 | 0.225 | 0.092 | 0.048 | 2.44 |
| 0.20 | 0.204 | 0.083 | 0.037 | 2.3 |
| 0.40 | 0.181 | 0.074 | 0.027 | 2.1 |
| 0.60 | 0.162 | 0.066 | 0.023 | 1.8 |
| 0.80 | 0.142 | 0.057 | 0.021 | 1.6 |
| 1.00 | 0.127 | 0.050 | 0.019 | 1.4 |

Result:

With an increasing throughput of the anodized aluminum surface there were observed decreases of the absorptions as characteristic for nickel and for the dye, respectively, and also a decrease of the nickel content as complexometrically determined. Thus, nickel ions and dye molecules had been simultaneously incorporated in the pores of the aluminum oxide hydrate layer.

Sheets were obtained which did not show any discolorations but had a natural metallic gloss.

Comparative Example A (no dye)

Under the same conditions as in Example 1, a solution was used for sealing which contained only 7.0 g/l of $NiF_2.4H_2O$; that is, it did not contain any dye. A comparable decrease of the absorptions as typical for nickel was observed, however the resulting surfaces showed a greenish discoloration.

Comparative Example B (dye outside inventive scope)

The initial solution contained 7.0 g/l of $NiF_2.4H_2O$ and 5.0 mg/l of aluminum copper (a dye outside the scope of this invention). The pH value was 5.8.

The sealing solution was allowed to sit for some time, whereupon it was observed that a colloidal dispersion had been formed and part of the dye had been precipitated from the solution. The results of the spectrophotometric and complexometric determinations of the nickel content and dye content are apparent from the subsequent Table 2.

TABLE 2

| $M^2$ of anodized surface per liter of bath | Extinct. at 395 nm (Ni conc.) | Extinct. at 505 nm (dye conc.) | Ni content complexo-metric. g/l |
|---|---|---|---|
| 0 | 0.219 | 0.084 | 2.36 |
| 0.20 | 0.199 | 0.080 | 2.0 |
| 0.40 | 0.184 | 0.077 | 1.9 |
| 0.60 | 0.167 | 0.076 | 1.7 |
| 0.80 | 0.142 | 0.075 | 1.4 |
| 1.00 | 0.128 | 0.075 | 1.3 |

Result:

While a consecutive decrease in the absorption value of nickel was found, the absorption value for the dye at 505 nm remained nearly constant. Thus, joint incorporation of the dye and the nickel ions in the pores of the aluminum oxide hydrate surface did not occur. Accordingly, the resulting surfaces also showed the usual green discoloration.

Example 2 (red dye)

The starting solution contained 7.0 g/l of $NiF_2.4H_2O$ and 5.0 mg/l of aluminum red GLW. The pH value was 5.8.

The consumption of the two components of the sealing solution was determined by means of spectrophotometry. The results are listed in the following Table 3.

TABLE 3

| $m^2$ of anodized surface per liter of bath | Extinct. at 395 nm (Ni conc.) | Extinct. at 720 nm (Ni conc.) | Extinct. at 500 nm (dye conc.) |
|---|---|---|---|
| 0 | 0.231 | 0.085 | 0.109 |
| 0.20 | 0.208 | 0.076 | 0.101 |
| 0.40 | 0.190 | 0.068 | 0.088 |
| 0.60 | 0.169 | 0.060 | 0.078 |
| 0.80 | 0.155 | 0.054 | 0.071 |
| 1.00 | 0.135 | 0.046 | 0.064 |

Result:

Both of the components diffused into the pores of the aluminum oxide hydrate surface. In consequence thereof colorless surfaces showing natural aluminum gloss were obtained.

Example 3 (red and violet dyes combined)

The starting solution contained:

5.5 g/l of $NiF_2.4H_2O$;

1.0 mg/l of aluminum red GLW; and 2 mg/l of aluminum violet CLW.

The results of the spectrophotometric extinction measurements are shown in Table 4.

TABLE 4

| $m^2$ of anodized surface per liter of bath | Extinct. at 395 nm (Ni conc.) | Extinct. at 720 nm (Ni conc.) | Extinct. at 500 nm (dye conc.) | Extinct. at 555 nm (dye conc.) |
|---|---|---|---|---|
| 0 | 0.219 | 0.085 | 0.044 | 0.040 |
| 0.20 | 0.203 | 0.077 | 0.038 | 0.033 |
| 0.40 | 0.182 | 0.068 | 0.031 | 0.026 |
| 0.60 | 0.166 | 0.060 | 0.028 | 0.025 |
| 0.80 | 0.146 | 0.053 | 0.023 | 0.018 |
| 1.00 | 0.129 | 0.045 | 0.020 | 0.014 |

Result:

The decrease in all of the four extinction values shows a simultaneous incorporation of nickel ions and dye molecules in the pores of the surface layers. In consequence thereof colorless aluminum oxide hydrate surfaces showing natural metal gloss were obtained.

Example 4 (red and violet dyes combined-with replenisher)

The starting solution contained:

5.5 g/l of $NiF_2.4H_2O$;

1.25 mg/l of aluminum red GLW; and 1.25 mg/l of aluminum violet CLW.

Dependently on the nickel content there were supplementarily added metered amounts of a replenisher solution containg:

32.7 g/l of $NiF_2.4H_2O$;

7.5 mg/l of aluminum red GLW; and 7.5 mg/l of aluminum violet CLW.

The values as determined by spectrophotometry and complexometry for the concentrations of nickel and dyes have been listed in the following Table 5.

TABLE 5

| $m^2$ of anodized surface per liter of bath | Extinction at 395 nm (Ni conc.) | Extinction at 720 nm (Ni conc.) | Extinction at 500 nm (dye conc.) | Extinction at 555 nm (dye conc.) | Ni content complexo-metrically g/l | Addition of suppl. solution ml/l |
|---|---|---|---|---|---|---|
| 0 | 0.164 | 0.068 | 0.038 | 0.027 | 1.9 | — |
| 0.1 | 0.154 | 0.063 | 0.034 | 0.022 | | 11.0 |
| 0.2 | 0.157 | 0.065 | 0.036 | 0.024 | | 7.4 |
| 0.3 | 0.154 | 0.063 | 0.036 | 0.023 | | 11.9 |
| 0.4 | 0.150 | 0.060 | 0.030 | 0.016 | | 16.8 |
| 0.5 | 0.148 | 0.058 | 0.025 | 0.010 | 1.7 | 22.1 |
| 0.6 | 0.159 | 0.063 | 0.027 | 0.011 | | 12.7 |
| 0.7 | 0.165 | 0.065 | 0.030 | 0.013 | | — |
| 0.8 | 0.160 | 0.062 | 0.028 | 0.012 | | 4.1 |
| 0.9 | 0.169 | 0.066 | 0.037 | 0.022 | | — |
| 1.0 | 0.147 | 0.054 | 0.027 | 0.012 | 1.7 | 26.0 |

Result:

Due to the addition of the replenisher solution the nickel ion content was nearly kept constant, while the dye concentration was still subject to wide variations. However, nickel and dye were incorporated in the pores of the aluminum oxide hydrate surface layer, and consequently surfaces showing natural metal gloss were obtained.

Example 5 (red and violet combined—with replenisher)

The starting solution contained:

5.7 g/l of $NiF_2.4H_2O$:

1.25 mg/l of aluminum red GLW; and 1.25 mg/l of aluminum violet CLW.

Dependently on the nickel content there were added metered amounts of a replenisher solution containing: 40.2 g/l of nickel ions, in the form of a mixture of:

105.6 g/l of $NiSO_4.6H_2O$; 62.8 g/l of Ni-acetate.4-$H_2O$; and 63.1 g/l of $NH_4F$; and 26.8 mg/l of dyes in the same proportion as used in the starting solution.

The values as determined by spectrophotometry and complexometry for the concentrations of nickel and dyes have been listed in the following Table 6.

TABLE 6

| $m^2$ of anodized surface per liter of bath | Extinction at 395 nm (Ni conc.) | Extinction at 720 nm (Ni conc.) | Extinction at 500 nm (dye conc.) | Extinction at 555 nm (dye conc.) | Ni content complexo-metrically g/l | Addition of suppl. solution ml/l |
|---|---|---|---|---|---|---|
| 0 | 0.206 | 0.078 | 0.050 | 0.039 | 2.0 | 0 |
| 0.1 | 0.186 | 0.073 | 0.045 | 0.035 | 1.9 | 0.75 |
| 0.2 | 0.173 | 0.067 | 0.041 | 0.031 | 1.7 | 2.7 |
| 0.3 | 0.166 | 0.063 | 0.039 | 0.029 | 1.6 | 5.2 |
| 0.4 | 0.169 | 0.063 | 0.040 | 0.030 | 1.6 | 4.5 |
| 0.5 | 0.176 | 0.066 | 0.044 | 0.033 | 1.7 | 2.55 |
| 0.6 | 0.173 | 0.064 | 0.042 | 0.031 | 1.6 | 6.7 |
| 0.7 | 0.185 | 0.068 | 0.045 | 0.034 | 1.7 | 3.0 |
| 0.8 | 0.188 | 0.070 | 0.048 | 0.036 | 1.8 | 2.5 |
| 0.9 | 0.185 | 0.069 | 0.046 | 0.035 | 1.9 | 2.5 |
| 1.0 | 0.203 | 0.078 | 0.052 | 0.041 | 2.0 | 3.5 |

Results:

Due to the addition of the replenisher solution in suitable amounts, the nickel ion and dye contents were adjusted to nearly constant values. The present replenisher solution proved to be best suitable for use with the predetermined experimental set-up. Colorless surfaces showing natural metal gloss were obtained.

Examples 6 and 7 (red and violet dys combined—with replenisher)

The starting solution contained:

5.7 g/l of $NiF_2.4H_2O$:

1.25 mg/l of aluminum red GLW; and 1.25 mg/l of aluminum violet CLW.

The replenisher solution contained: 30 g/l of nickel ions, in the form of a mixture of:

79.2 g/l of $NiSO_4.6H_2O$;

47.1 g/l of Ni-acetate.$4H_2O$; and 46.75 g/l of $NH_4F$; and 18.75 mg/l of dyes in the same proportion as used in the starting solution.

Sheets having layer thicknesses of 20μ (Example 6) and of 5μ (Example 7) were sealed.

The results as determined by spectrophotometry and complexometry for the respective concentrations of nickel and dyes have been listed in the following Tables 7 (for Example 6) and 8 (for Example 7).

TABLE 7

(Example 6)

| $m^2$ of anodized surface per liter of bath | Extinction at 395 nm (Ni conc.) | Extinction at 720 nm (Ni conc.) | Extinction at 500 nm (dye conc.) | Extinction at 555 nm (dye conc.) | Ni content complexo-metrically g/l | Addition of suppl. solution ml/l |
|---|---|---|---|---|---|---|
| 0 | 0.178 | 0.065 | 0.035 | 0.025 | — | 0 |
| 0.1 | 0.158 | 0.056 | 0.027 | 0.016 | 1.9 | 3.5 |
| 0.2 | 0.154 | 0.053 | 0.029 | 0.018 | 1.8 | 5.0 |
| 0.3 | 0.162 | 0.057 | 0.030 | 0.019 | 1.9 | 1.1 |
| 0.4 | 0.155 | 0.054 | 0.032 | 0.021 | 1.7 | 7.0 |
| 0.5 | 0.158 | 0.055 | 0.030 | 0.019 | 1.8 | 3.0 |
| 0.6 | 0.155 | 0.052 | 0.031 | 0.019 | 1.8 | 5.0 |
| 0.7 | 0.159 | 0.055 | 0.032 | 0.021 | 1.8 | 5.0 |
| 0.8 | 0.161 | 0.055 | 0.034 | 0.022 | 1.8 | 3.1 |
| 0.9 | 0.160 | 0.056 | 0.036 | 0.023 | 1.8 | 5.0 |
| 1.0 | 0.182 | 0.066 | 0.040 | 0.028 | 1.8 | 6.8 |

TABLE 8

(Example 7)

| $m^2$ of anodized surface per liter of bath | Extinction at 395 nm (Ni conc.) | Extinction at 720 nm (Ni conc.) | Extinction at 500 nm (dye conc.) | Extinction at 555 nm (dye conc.) | Ni content complexo-metrically g/l | Addition of suppl. solution ml/l |
|---|---|---|---|---|---|---|
| 0 | 0.192 | 0.077 | 0.046 | 0.035 | 1.95 | 0 |
| 0.1 | 0.188 | 0.078 | 0.050 | 0.039 | 1.86 | 1.8 |
| 0.2 | — | — | — | — | — | 5.4 |
| 0.3 | 0.201 | 0.082 | 0.052 | 0.042 | 1.99 | — |
| 0.4 | 0.189 | 0.078 | 0.049 | 0.038 | 1.76 | 4.5 |
| 0.5 | 0.193 | 0.079 | 0.049 | 0.039 | 1.76 | 4.5 |
| 0.6 | 0.199 | 0.089 | 0.050 | 0.039 | 1.82 | 2.7 |
| 0.7 | 0.197 | 0.080 | 0.050 | 0.039 | 1.88 | 0.8 |
| 0.8 | 0.192 | 0.075 | 0.048 | 0.037 | 1.82 | 2.8 |
| 0.9 | 0.197 | 0.078 | 0.049 | 0.039 | 1.76 | 4.7 |
| 1.0 | 0.205 | 0.082 | 0.051 | 0.041 | 1.95 | — |

Result:

Independently of the layer thickness, the content of the nickel ions and the dye molecules in the sealing solutions were kept almost constant by topping up the latter using the replenisher solutions as described above. Both colorant components were incorporated in the pores of the aluminum oxide hydrate surface layer to the extent as required. In consequence thereof layers of uncolored appearance and having natural metal gloss were formed.

Example 8 (red and violet dyes combined—continuous replenishment)

A solution for use in cold impregnating was prepared in a bath container having a capacity of 18 $m^3$ which solution contained 2 g/l of nickel and 1.4 g/l of fluoride. 1.25 mg/l of aluminum red GLW and 1.25 mg/l of aluminum violet CLW were added, so that upon visual inspection the solution appeared to be colorless. During a first eight week test period, aluminum articles having anodized aluminum surfaces totaling 11,500 $m^2$ and comprising oxide layer thicknesses of from 2μ to 25μ which had been prepared under varied anodization conditions, were treated in the bath.

The nickel content was determined by complexometric titration. The dye contents were photometrically controlled. A nickel salt solution which also contained the above-identified dyes was added when required, in order to maintain the nickel concentration at 2 g/l. Such solution contained nickel and dyes (50% aluminum red GLW and 50% aluminum violet CLW) in a ratio by weight of 1:0.0015. The overall consumption was 12.3 kg of nickel and 18 g of the dye mixture. All parts having been thus treated could be impregnated to have a colorless appearance, i.e. without showing any green discoloration. The solution upon a visual inspection also remained colorless. (In this case by way of a photometric analysis a slight decrease in the dye concentrations could be detected, since due to an undesired introduction of hard water calcium fluoride had been precipitated, and the calcium fluoride precipitate had adsorbed portions of the dyes. Due to the extinction measurement it was possible to replenish the missing amount of dye of 7 grams).

We claim:

1. A process for producing colorless, cold-sealed, anodized aluminum or aluminum alloy surfaces comprising the treatment of said surfaces at a temperature of about 15°-70° C. with (A) an aqueous solution consisting essentially of nickel ions, present in a sealingly effective amount and (B) an aqueous solution consisting essentially of at least one organic dye present in an amount effective to offset any color imparted to said surface by said nickel ions which (a) has an absorption maximum of about from 450 to 600 nm;

(b) has an extinction coefficient of at least $10^3$ liter/mol cm;

(c) is capable of being dissolved to form a molecular dispersion; and (d) does not undergo a precipitation reaction with nickel ions or the other components of the solution at the treatment solution concentrations wherein said solutions are used simultaneously or in any sequence.

2. The process of claim 1 wherein step (A) preceeds step (B).

3. The process of claim 1 wherein step (B) preceeds step (A).

4. The process of claim 1 wherein steps (A) and (B) are simultaneously effected by combining said nickel ion solution and said dye solution.

5. The process of claim 1 wherein said at least one dye has an absorption maximum of about from 490 to 560 nm.

6. The process of claim 1 wherein said at least one dye has an extinction coefficient of about from $5\times10^3$ to $5\times10^5$ liter/mol cm.

7. The process of claim 5 wherein said at least one dye has an extinction coefficient of about from $5\times10^3$ to $5\times10^5$ liter/mol cm.

8. The process of claim 1 wherein said at least one dye has an extinction coefficient of about $10^4$ liter/mol cm.

9. The process of claim 5 wherein said at least one dye has an extinction coefficient of about $10^4$ liter/mol cm.

10. The process of claim 1 wherein said at least one dye is an azo dye, an azo metal dye, or their combination.

11. The process of claim 1 wherein said at least one dye is aluminum red GLW, aluminum violet CLW, or their combination.

12. The process of claim 2 wherein said at least one dye is aluminum red GLW, aluminum violet CLW, or their combination.

13. The process of claim 3 wherein said at least one dye is aluminum red GLW, aluminum violet CLW, or their combination.

14. The process of claim 4 wherein said at least one dye is aluminum red GLW, aluminum violet CLW, or their combination.

15. The process of claim 1 wherein the overall concentration of said at least one dye is adjusted to about 0.5 to 80 mg per liter of total solution.

16. The process of claim 1 wherein the overall concentration of said at least one dye is adjusted to about 1 to 10 mg per liter of total solution.

17. The process of claim 1 wherein the overall concentration of said at least one dye is adjusted to about 1 to 2.9 mg per liter of total solution.

18. The process of claim 1 wherein said treatment is conducted at a pH of about 5 to 7.5.

19. The process of claim 18 wherein said treatment is conducted at a temperature of about 20° to 40° C.

20. The process of claim 18 wherein said treatment is conducted at a temperature of about 25° to 32° C.

21. The process of claim 18 wherein said pH is about 5.5 to 7.0.

22. The process of claim 18 wherein said pH is about 5.5 to 6.5.

23. The process of claim 1 wherein said treatment is conducted at a temperature of about 25° to 32° C. and at a pH of about 5.5 to 6.5.

24. The process of claim 4 wherein said nickel ions and said at least one organic dye are replenished by the addition of further quantities of each sufficient to restore their original concentrations.

25. The process of claim 24 wherein said replenishment is continuous.

26. The process of claim 4 wherein: said at least one dye consists essentially of a combination of aluminum red GLW and aluminum violet CLW, said combination being present in about 1 to 2.9 mg/l; said nickel ions are present in an amount effective to seal said surfaces; the temperature of said treatment is at about 25° to 32° C.; and the pH of said combined solutions is about 5.5 to 6.5.

27. A composition for producing colorless, cold-sealed, anodized aluminum or aluminum alloy surfaces consisting essentially of the mixture:

(A) an aqueous solution containing nickel ions present in a sealingly effective amount; and (B) an aqueous solution containing at least one organic dye present in an amount effective to offset any color imparted to said aluminum or aluminum alloy surface by said nickel ions, wherein said at least one organic dye (a) has an absorption maximum of from 450 to 600 nm;

(b) has an extinction coefficient of at least $10^3$ liter/mol cm;

(c) is capable of being dissolved to form a molecular dispersion; and (d) does not undergo a precipitation reaction with nickel ions or the other components of said solution at the treatment solution concentration.

28. The composition of claim 27 wherein said at least one organic dye has an absorption maximum of from 490 to 560 nm.

29. The composition of claim 27 wherein said at least one organic dye has an extinction coefficient of about $5\times10^3$ to $5\times10^5$ liter/mol cm.

30. The composition of claim 27 wherein said at least one organic dye is present in a concentration of about 1.0–10.0 mg/l of the sealing solution.

31. The composition of claim 27 wherein said at least one organic dye is: an azo metal complex-containing copper red dye having an absorption maximum of about 500 nm; a purely organic azo violet dye having an absorption maximum of about 555 nm; or a mixture thereof.

32. The composition of claim 27 wherein said nickel ions are produced by the salts: nickel fluoride tetrahydrate; nickel sulfate; nickel acetate; or a mixture thereof; with corresponding amounts of alkali metal fluorides.

33. The composition of claim 27 wherein said nickel ions are present in a concentration of about 1–5 g/l, based on the total amount of the aqueous composition.

34. The composition of claim 31 wherein said nickel ions are present in about 2 g/l and said at least one organic dye is present in about 2.5 mg/l, based on the total amount of the aqueous composition.

35. The composition of claim 34 wherein said nickel ions are produced by the salts: nickel fluoride tetrahydrate; nickel sulfate; nickel acetate; or a mixture thereof; with corresponding amounts of alkali metal fluoride.

* * * * *